US006692303B2

(12) United States Patent
Fukatsu

(10) Patent No.: US 6,692,303 B2
(45) Date of Patent: Feb. 17, 2004

(54) TERMINAL FITTING, A CONNECTOR AND A METHOD FOR FORMING A TERMINAL FITTING THAT FACILITATE INSERTION OF THE TERMINAL FITTING INTO THE CONNECTOR

(75) Inventor: Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/243,574

(22) Filed: Sep. 13, 2002

(65) Prior Publication Data

US 2003/0054690 A1 Mar. 20, 2003

(30) Foreign Application Priority Data

Sep. 18, 2001 (JP) ..... 2001-282876

(51) Int. Cl.[7] ..... H01R 13/40; H01R 13/514

(52) U.S. Cl. ..... 439/595; 439/752

(58) Field of Search ..... 439/595, 752, 439/252, 884

(56) References Cited

U.S. PATENT DOCUMENTS 5,292,262 A 3/1994 Endo et al.
5,520,548 A * 5/1996 Hotea et al. ..... 439/358
5,800,220 A * 9/1998 Feeny et al. ..... 439/849
6,077,103 A * 6/2000 Saka et al. ..... 439/397
6,375,501 B1 * 4/2002 Kojima ..... 439/595
6,390,860 B2 * 5/2002 Shirouzu et al. ..... 439/752.5
6,524,143 B2 * 2/2003 Chen ..... 439/852
2003/0049965 A1 * 3/2003 Fujita et al. ..... 439/595

FOREIGN PATENT DOCUMENTS

JP 5-226025 9/1993

* cited by examiner

*Primary Examiner*—Chandrika Prasad
(74) *Attorney, Agent, or Firm*—Gerald E. Hespos; Anthony J. Casella

(57) ABSTRACT

A terminal fitting (20) has a bottom wall (25) and first and second sidewalls (26) bent angularly from the sidewalls (26). A locking hole (28) is formed in the bottom wall (28) and extends to the sidewalls (26). A pair of notches (29) is formed in each sidewall (26) and communicates with the locking hole (28). Areas (26A) of each sidewall (26) between the respective pair of notches (29) is substantially planar and has a bottom edge substantially at the same height as the lower surface of a bottom wall (25).

11 Claims, 5 Drawing Sheets

TERMINAL FITTING, A CONNECTOR AND A METHOD FOR FORMING A TERMINAL FITTING THAT FACILITATE INSERTION OF THE TERMINAL FITTING INTO THE CONNECTOR

BACKGROUND OF THE INVENTION

1. Field of the Invention

The invention relates to a terminal fitting, to a connector with a terminal fitting and to a method for forming a terminal fitting.

2. Description of the Related Art

A known connector has a housing with opposite front and rear ends and an accommodation recess is formed in the rear end of the housing. Cavities extend between the front end and the accommodation recess for receiving terminal fittings. The connector also has a one-piece rubber plug in the accommodation recess and a holder for holding the rubber plug in the accommodation recess. The rubber plug and the holder have wire-introducing holes and insertion holes corresponding to the cavities in the housing.

The terminal fitting to be inserted into such a connector is secured to an end of a wire and has a bottom wall, left and rights sidewalls that extend up from the left and right edges of the bottom wall, and a locking hole formed in the bottom wall, as shown in Japanese Unexamined Patent Publication No. 5-226025. The terminal fitting is inserted into the cavity after successively passing through the insertion hole of the holder and the wire-introducing hole of the rubber plug. A resin lock in the cavity engages the locking hole so that the terminal fitting inserted into the cavity is held so as not to come out. Inner circumferential surfaces of the wire-introducing holes of the rubber plug closely contact outer circumferential surfaces of the wires and the outer surface of the rubber plug closely contacts the inner surface of the accommodation recess. Thus water will not enter into the housing.

In recent years, there has been a demand to make connectors smaller and, accordingly, terminal fittings have become smaller. The locking hole of a smaller terminal fitting extends over the entire width of the bottom wall to maximize the area of engagement between the resin lock and the locking hole.

Sidewalls of the terminal fitting are bent up from the bottom wall, and the bending operation invariably produces arcuate boundaries between the bottom wall and the sidewalls. The locking hole necessarily extends into the arcuate bent boundaries between the bottom wall and the sidewalls in the above-described situations where a maximum width locking hole extends completely across the bottom wall. This extension of the locking hole into the arcuate boundaries adjacent the sidewalls avoids leaving parts of the bottom wall at the opposite lateral edges of the locking hole.

The arcuate boundaries between the bottom wall and the sidewalls include the bottom ends of the sidewalls. Hence, the portions of the locking hole that extend into the arcuate bend define recesses in the bottom ends of the respective sidewalls when the terminal fitting is viewed sideways. The recesses may catch the entrance edge of the insertion hole of the holder when the terminal fitting is inserted obliquely into the holder. Consequently, insertion of the terminal fitting may be hindered or the terminal fitting may be deformed.

The invention was developed in view of the above problem and an object thereof is to improve the operability of a terminal fitting, particularly to prevent the terminal fitting from getting caught while being inserted into a connector.

SUMMARY OF THE INVENTION

The invention is directed to a terminal fitting that is insertable into a connector. The terminal fitting comprises a bottom wall and sidewalls that project angularly and preferably normally from the left and right edges of the bottom wall. A locking hole is formed in the bottom wall and extends over substantially the entire width of the bottom wall for engagement with a lock of a connector. Each sidewall has a pair of notches formed by cutting away only the front and rear ends of an area substantially corresponding to the locking hole so as to communicate with the locking hole.

The locking hole preferably is formed in the bottom wall before bending.

Preferably, an area of each sidewall between the notches is substantially planar. Thus, an area of the locking hole can extend over the entire width of the bottom wall to ensure a sufficiently large engaged area with the resin lock.

The bottom edge of an area of each sidewall between the notches is substantially at the same height as the lower surface of the bottom wall. Thus, the portions of the sidewall corresponding to the locking hole are not recessed when the terminal fitting is viewed sideways and, accordingly, the terminal fitting does not get caught by the insertion hole and the like during insertion.

Arcuate bent portions are formed at boundaries between the bottom wall and the sidewalls when the sidewalls are bent as to stand up from the opposite lateral edges of the bottom wall. However, the areas of the side walls corresponding to the locking hole are separated from the arcuate bent portions by the notches. Thus, these areas can remain substantially planar, and are not influenced by the bending operation.

The connector preferably comprises a sealing plug to be accommodated in an accommodation recess at a rear end of a connector housing. The sealing plug has at least one wire-introducing hole corresponding to the cavities for the corresponding terminal fitting. The connector also comprises a holder with at least one insertion hole corresponding to the wire-introducing holes and adapted to prevent a loose backward movement of the sealing plug. The terminal fitting is insertable into the cavity after successively passing through the insertion hole and the wire-introducing hole.

A terminal fitting in which the portions of the sidewalls corresponding to the locking hole are recessed inclines when the entrance edge of the insertion hole catches the recesses. As a result that the leading end of the terminal fitting may be stuck in the rubber plug. However, the terminal fitting of the subject invention has no recesses. Thus, the inclination of the terminal fitting is small even if the terminal fitting contacts the entrance edge of the insertion hole, and the terminal fitting will not stick in the rubber plug.

A slanted bevel preferably is formed at a bottom end of each sidewall between the notches substantially corresponding to an arcuate bent boundary between the bottom wall and the sidewall. Thus, there is no possibility that corners of the bottom ends of the sidewalls bulge out obliquely downward from the arcuate bends to catch the entrance edge of the insertion hole.

The invention also is directed to a connector comprising a housing with at least one cavity and formed in its rear end surface with at least one insertion hole substantially corresponding to the cavity. At least one of the above-described terminal fittings is passed through the insertion hole and is inserted into the cavity. The terminal fitting is held by the engagement of the locking hole with a lock in the cavity.

The connector preferably comprises a sealing plug accommodated in an accommodation recess at a rear end of the housing. The plug may have at least one wire-introducing hole corresponding to the cavity for accommodating the corresponding terminal fitting. The connector also may have a holder with at least one insertion hole corresponding to the wire-introducing hole and adapted to prevent a loose backward movement of the sealing plug. The terminal fitting is insertable into the cavity after successively passing through the insertion hole and the wire-introducing hole.

The invention also relates to a method for forming a terminal fitting for insertion into a connector. The method comprises providing a metal plate and bending the metal plate to define sidewalls that project angularly from left and right edges of a bottom wall. The method also comprises forming a locking hole in the bottom wall to extend substantially over the entire width of the bottom wall for engaging a lock in the connector. Each sidewall is formed with a pair of notches by cutting away only the front and rear ends of an area substantially corresponding to the locking hole so as to communicate with the locking hole.

The locking hole preferably is formed in the bottom wall in before the bending step.

Preferably, an area of each sidewall between the notches is substantially planar.

The bottom edge of an area of each sidewall between the notches preferably is formed to be substantially at the same height as the lower surface of the bottom wall.

The method may further comprise forming a slanted bevel at a bottom end of each sidewall between the notches and substantially corresponding to an arcuate bend at a boundary between the bottom wall and the sidewall.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTIONS OF THE DRAWINGS

DETAILED DESCRIPTION OF THE PREFERRED EMBODIMENTS

Figure 1:
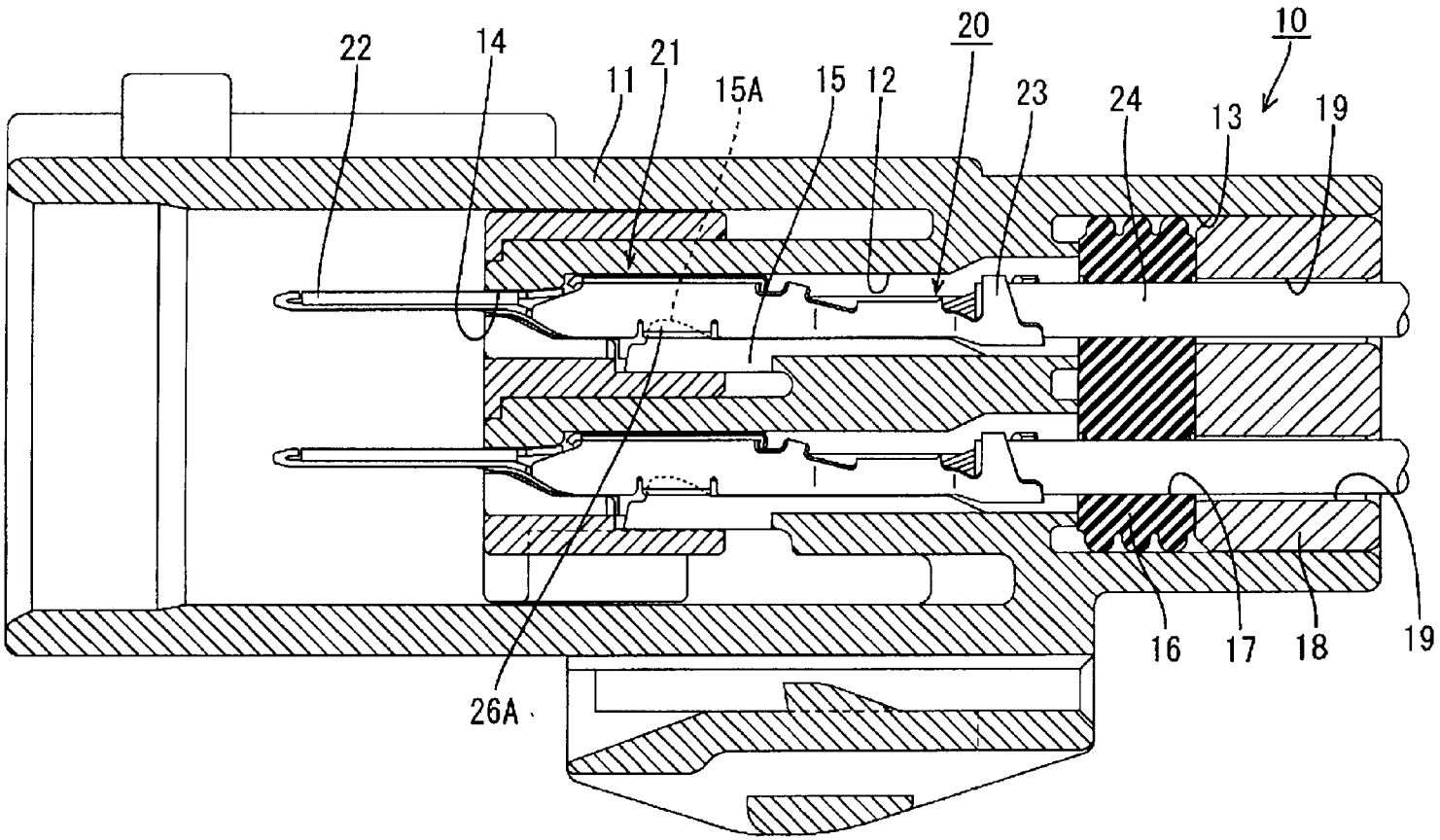
FIG. 1 is a vertical section showing a state where terminal fittings are inserted into a connector in one embodiment of the invention.
Figure 2:
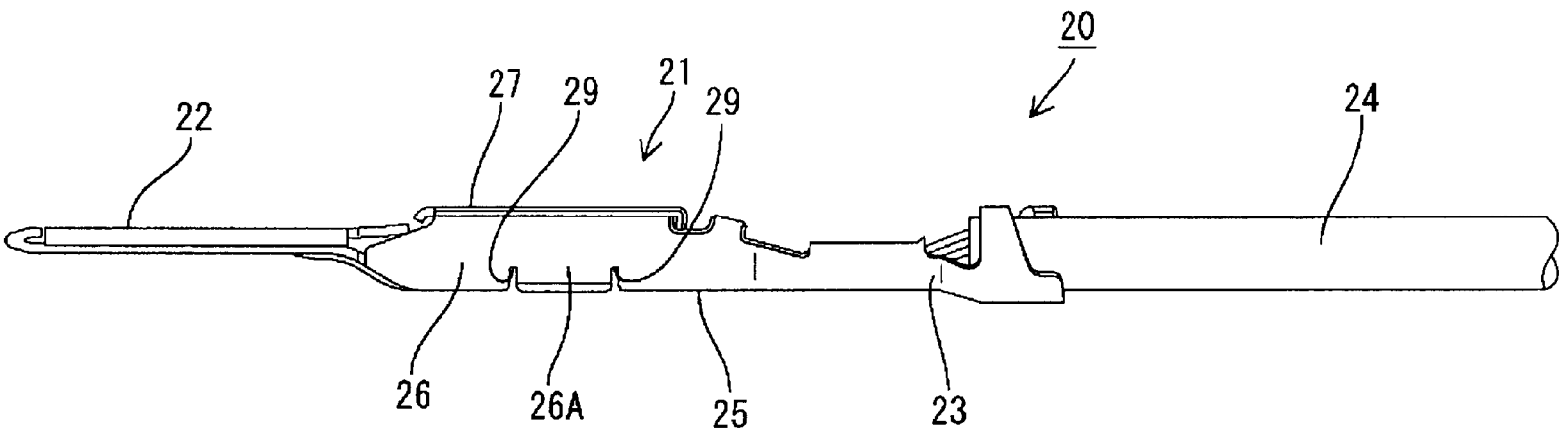
FIG. 2 is a side view of the terminal fitting.
Figure 3:
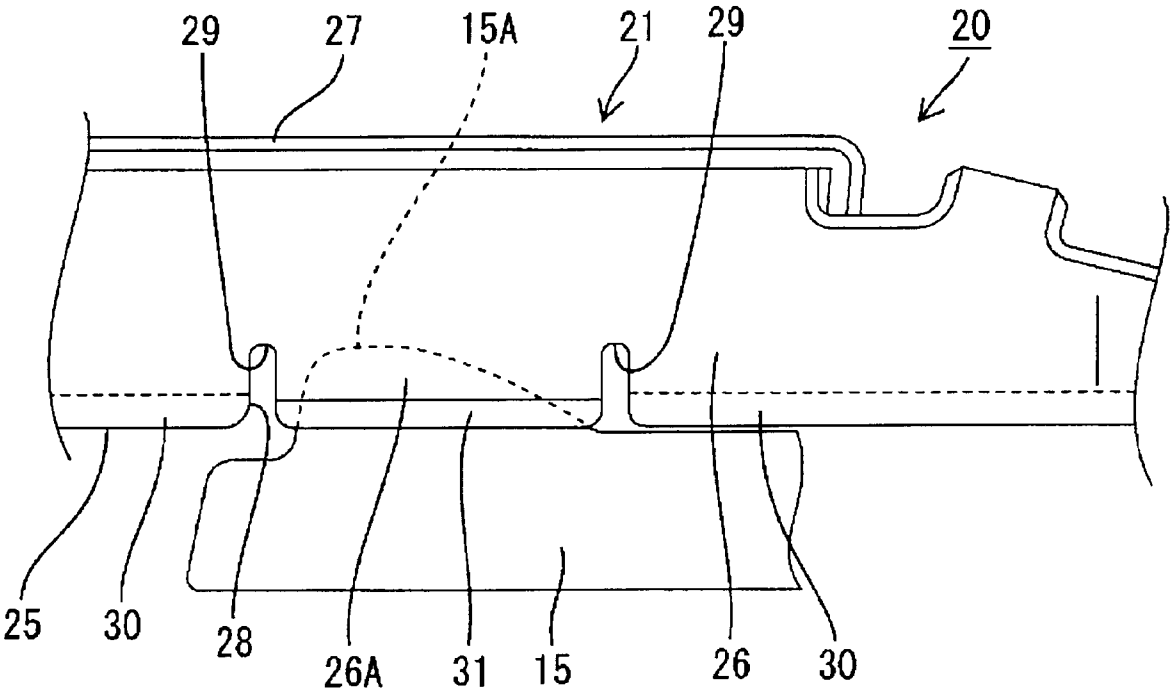
FIG. 3 is an enlarged partial side view of the terminal fitting.
Figure 4:
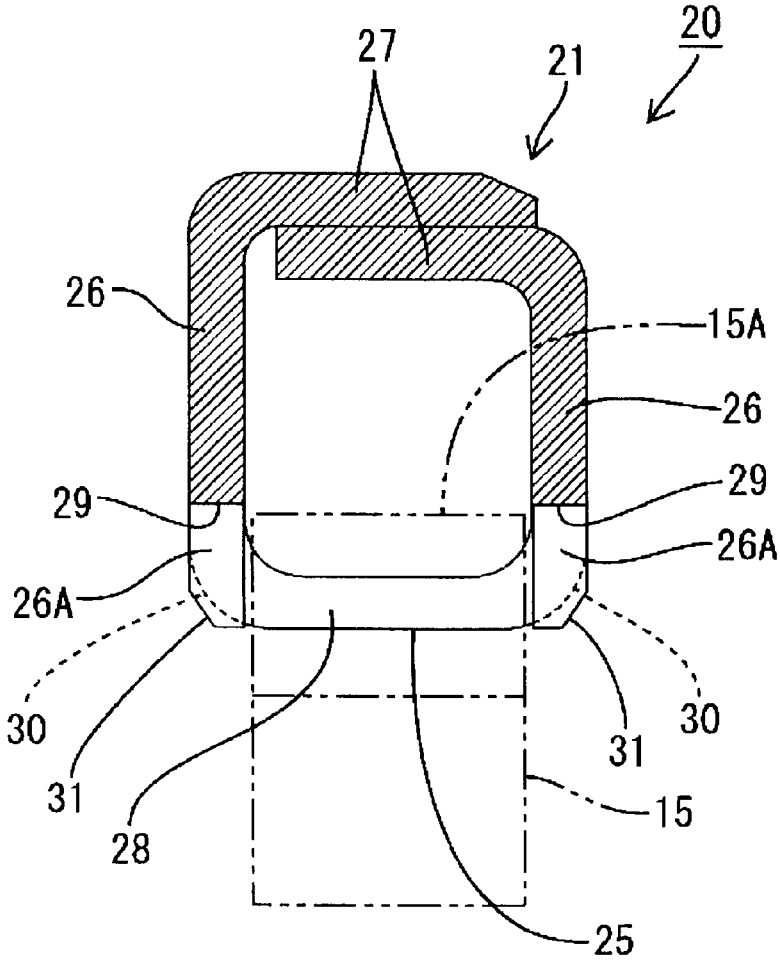
FIG. 4 is an enlarged partial lateral section of the terminal fitting.

A connector according to the invention is identified by the numeral 10 in FIG. 1. The connector 10 has a synthetic resin housing 11 with opposite front and rear ends. An accommodation recess 13 extends into the rear end of the housing 11 and cavities 12 extend forward from the accommodation recess 13. Tab insertion holes 14 extend into the front end of the housing 11 and communicate with the respective cavities 12. Each cavity 12 has a resin lock 15 that cantilevers forward along the inner bottom surface of the cavity 12 and a locking projection 15A is formed at the front end of each lock 15.

The connector 10 further includes a one-piece rubber plug 16 configured for mounting in contact with the back end surface of the accommodation recess 13. Wire-introducing holes 17 penetrate the rubber plug 16 in forward and backward directions and are arranged to correspond to the respective cavities 12. The outer peripheral surface of the rubber plug 16 is configured for resilient hermetic contact with the inner peripheral surface of the accommodation recess 13.

The connector 10 further includes a holder 18 configured for mounting at the entrance to the accommodation recess 13. Insertion holes 19 penetrate the holder 18 in forward and backward directions and are arranged to correspond to the respective wire-introducing holes 17. The holder 18 prevents a loose movement and withdrawal of the rubber plug 16 from the accommodation recess 13.

The connector further includes terminal fittings 20 that are formed by cutting, bending, folding and/or embossing a metallic plate material stamped or cut out into a specified shape. Each terminal fitting 20 has opposite front and rear ends and a substantially rectangular tube 21 between the ends. A narrow tab 22 projects forward from the rectangular tube 21, and a wire-crimping portion 23 extends back from the rectangular tube 21. The wire-crimping portion 23 is configured to be crimped, bent or folded into connection with an end of a wire 24. The rectangular tube 21 has a long narrow bottom wall 25 that extends in forward and backward directions. Left and right sidewalls 26 project up from the left and right edges of the bottom wall 25 at substantially a right angle. Upper walls 27 extend in from the upper edges of both sidewalls 26 and are placed at least partly over one another. The bottom wall 25 is formed with a locking hole or recess 28.

The terminal fitting 20 can be inserted into the corresponding cavity 12 from behind the connector 10 after passing through the insertion hole 19 of the holder 18 and the wire-introducing hole 17 of the rubber plug 16 while the tab 22 is facing forward. The inserted terminal fitting 20 is held so as not to come out by the engagement of the locking projection 15A of the resin lock 15 with the locking hole 28. The inner circumferential surface of the wire-introducing hole 17 resiliently and hermetically contact the outer circumferential surface of the wire 24 secured to the terminal fitting 20.

The locking hole 28 extends over substantially the entire width of the bottom wall 25 to ensure a maximum engageable area with the resin lock 15 along the widthwise direction. Further, the left and right sidewalls 26 each are formed with front and rear notches 29 that align with the locking hole 28. Thus, the notches 29 communicate with the locking hole 28 and are at positions substantially corresponding to the edges of the locking hole 28 along the longitudinal direction of the terminal fitting 20. The notches 29 extend up from the bottom edges of the sidewalls 26, i.e. the left and right edges of the bottom wall 25, and the upper ends of the notches 29 are higher than arcuate bends 30 formed at boundaries between the walls 25 and 26 when the sidewalls 26 are bent up from the bottom wall 25. An area 26A of each sidewall 26 between the front and rear notches 29 remains substantially planar and has a bottom edge substantially at the same height as the lower surface of the bottom wall 25. Specifically, the arcuate bends 30 are formed at boundaries between the bottom wall 25 and the sidewalls 26 when the sidewalls 26 are bent up from the opposite lateral edges of the bottom wall 25. However, the areas 26A of the sidewalls 26 corresponding to the locking hole 28 are separated from the arcuate bends 30 by the notches 29. Thus, these areas 26A remain substantially planar and are not influenced by the bending operation.

A slanted bevel 31 is formed at the bottom outer edge of the area 26A of each sidewall 26 between the front and rear notches 29. Each bevel 31 has a profile substantially corresponding to the arcuate bend 30 at the boundary between the bottom wall 25 and the sidewall 26. If no bevel 31 was formed at the bottom of the sidewall 26, the outer bottom corner of the sidewall 26 would bulge out obliquely down when the terminal fitting 20 is viewed from the front. However, the bevels 31 enable the bottom ends of the sidewalls 26 to bulge out only slightly from the outer surfaces of the arcuate bent portions 30.

Figure 5:
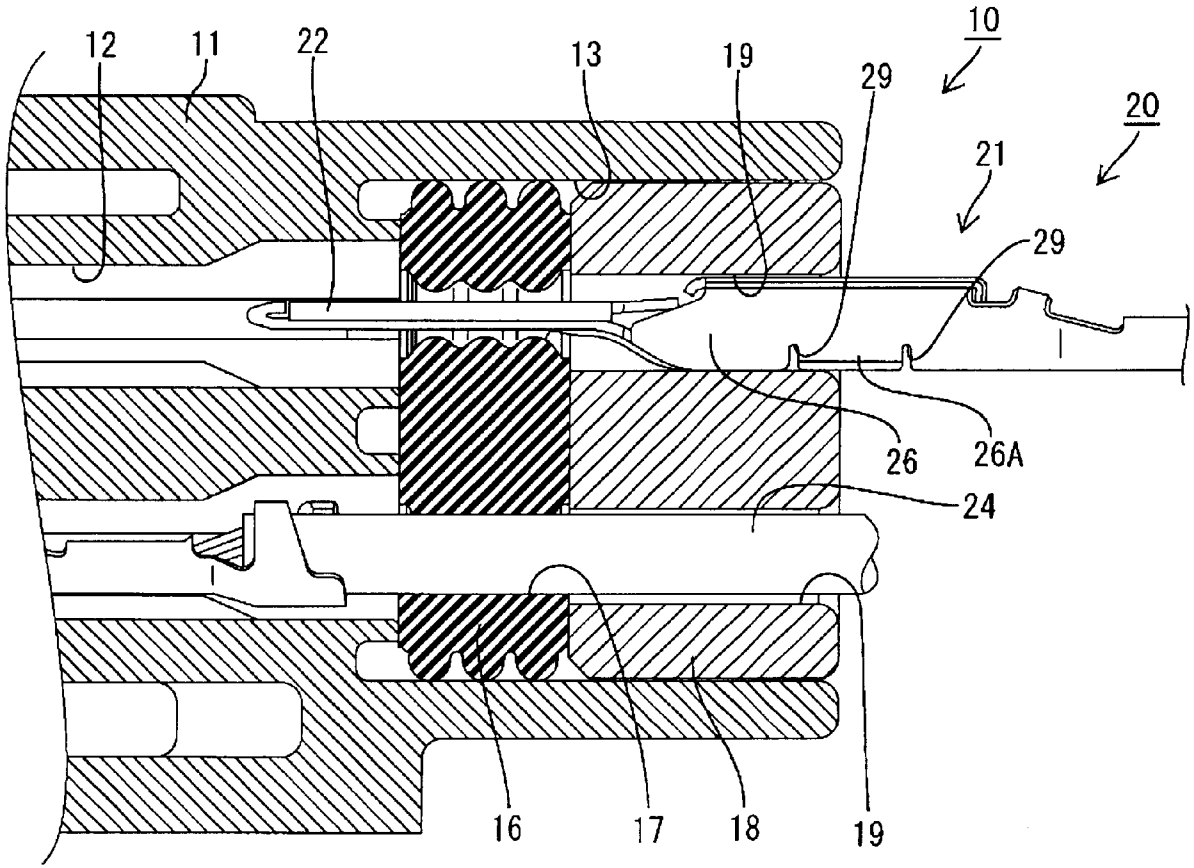
FIG. 5 is a partial longitudinal section showing a state where the terminal fittings are inserted into insertion holes of the connector.

The terminal fitting 20 is inserted into the connector 10, and the bottom wall 25 is held in sliding contact with the entrance edge of the insertion hole 19 of the holder 18 as shown in FIG. 5. However, the bottom edges of the areas 26A of the sidewalls 26 corresponding to the locking hole 28 are at substantially the same height as the lower surface of the bottom wall 25. Further, the dimension of the notches along forward and backward directions at the bottom edges of the sidewalls 26 is very small. Accordingly, portions of the sidewalls 26 corresponding to the locking hole 28 are not recessed significantly when the terminal fitting 20 is viewed sideways and, even if the bottom wall 25 is held in sliding contact with the edge of the insertion hole 19 during insertion, there is substantially no possibility that the bottom wall 25 gets caught.

The areas 26A of the sidewalls 26 corresponding to the locking hole 28 are substantially planar from their upper ends to their bottom ends. Thus, an area of the locking hole 28 extends over the entire width of the bottom wall 25. This enables a maximum width of the resin lock 15 so that the resin lock 15 is held in contact with the inner surfaces of the sidewalls 26, thereby ensuring a maximum engaged area of the locking hole 28 and the resin lock 15.

If portions of the sidewalls corresponding to the locking hole were recessed, the terminal fitting would tilt when these recesses caught the entrance edge of the insertion hole 19. As a result, the leading end of the terminal fitting could be stuck in the rubber plug 16. However, the terminal fitting 20 of the invention has no recess. Thus, even if the terminal fitting 20 tilts in the insertion hole 19, the inclination will be small and the terminal fitting 20 will not stick in the rubber plug 16.

If the outer corners of the bottom ends of the sidewalls were left as sharp right angles, they would bulge out obliquely downward from the arcuate bends and may catch the entrance edge of the insertion hole. However, the slanted bevels 31 are formed at the bottom ends of the sidewalls 26 in this invention and correspond to the arcuate bends 30 at the boundaries between the bottom wall 25 and the sidewalls 26. Thus, the bottom ends of the sidewalls 26 do not catch the entrance edge of the insertion hole 19.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the male terminal fitting having the tab at its leading end is described in the foregoing embodiment, the present invention is also applicable to female terminal fittings with no tab.

A one-piece rubber plug and holder for locking this rubber plug is described in the foregoing embodiment. However, the invention is also applicable to rubber plugs that are mounted individually on the terminal fittings.

Although a watertight connector is described in the foregoing embodiment, the invention also is applicable to non-watertight connectors.

The insertion holes in the rear of the connector are formed in the holder for locking the one-piece rubber plug in the foregoing embodiment. However, the invention also is applicable if the insertion holes are formed in a back retainer to be mounted into the connector housing to lock the terminal fittings instead of being formed in the holder.

What is claimed is:

1. A terminal fitting, comprising:

a bottom wall with first and second opposite longitudinal sides, a locking hole extending substantially entirely across the bottom wall from the first side to the second side, the bottom wall having a lower surface; and first and second sidewalls projecting angularly up from the respective first and second sides of the bottom wall and away from the lower surface of the bottom wall, spaced apart notches formed in each said sidewall at locations substantially aligned with the locking hole so that the notches communicate with the locking hole, an edge of each of said sidewalls between the respective notches being substantially aligned with the lower surface of the bottom wall.

2. The A terminal fitting, comprising:

a bottom wall with first and second opposite longitudinal sides, a locking hole extending substantially entirely across the bottom wall from the first side to the second side, the bottom wall having a bottom surface;

first and second sidewalls projecting angularly up from the respective first and second sides of the bottom wall and away from the lower surface of the bottom wall, spaced apart notches formed in each said sidewall at locations substantially aligned with the locking hole so that the notches communicate with the locking hole, wherein a slanted bevel is formed at a bottom end of each sidewall between the respective notches and substantially aligns with an arcuate bend at a boundary between the bottom wall and the respective sidewall.

3. The terminal fitting of claim 1, wherein the locking hole has opposed front and rear edges extending substantially normally between the arcuate bends, each said pair of notches comprising a front notch aligned substantially with the front edge of the locking hole and a rear notch aligned substantially with the rear edge of the locking hole.

4. The terminal fitting of claim 1, wherein the sidewalls are substantially normal to the bottom wall.

5. A connector comprising:

a housing having opposite front and rear ends and cavities extending through the housing between the front and rear ends; and terminal fittings in the respective cavities each said terminal fitting having a bottom wall with first and second opposite longitudinal sides and a lower surface, a locking hole extending substantially entirely across the bottom wall from the first side to the second side, and first and second sidewalls projecting angularly up from the respective first and second sides of the bottom wall and away from the lower surface, spaced apart notches formed in each said side wall at locations substantially aligned with the locking hole so that the notches communicate with the locking hole, an edge of each of said sidewalls between the respective notches being substantially aligned with the lower surface of the bottom wall.

6. The connector of claim 5, wherein the housing is formed with locks projecting respectively into the cavities and configured for engaging the locking hole of the respective terminal fitting for locking the terminal fitting in the respective cavity.

7. The connector of claim 6, wherein the rear end of the housing has a recess communicating with the cavities, the connector further comprising a sealing plug in the recess and having wire-introducing holes corresponding to the cavities and a holder having insertion holes corresponding to the wire-introducing holes, the holder engaging the housing for preventing a loose movement of the sealing plug, the terminal fittings being insertable through the insertion holes and the wire-introducing holes and into the respective cavities.

8. A method for forming a terminal fitting, comprising:

providing a metal plate; forming a locking hole (28) in the metal plate, the locking hole having opposite first and second substantially parallel side edges and having opposite substantially parallel front and rear edges;

forming spaced apart front and rear notches extending from the first side edge of the locking hole at locations aligned with the front and rear edges of the locking hole and forming spaced apart front and rear notches extending from the second side edge of the locking hole at locations aligned respectively with the front and rear edges of the locking hole; and bending the metal plate to define substantially parallel first and second arcuate bends substantially aligned respectively with the first and second side edges of the locking hole, such that portions of the metal plate between the bends define a bottom wall having the locking hole therein and having a lower surface facing outwardly on the terminal fitting, and such that portions of the metal plate having the notches define sidewalls angularly aligned to the bottom wall, the step of bending being carried out such that edges of the sidewalls between the notches substantially align with the lower surface of the bottom wall.

9. The method of claim 8, wherein the step of forming the locking hole is performed before the step of bending the metal plate.

10. The method of claim 8, wherein an area of each sidewall between the respective pair of notches is formed to be substantially planar.

11. The method of claims 8, further comprising beveling the side edges of the locking hole to define a slanted surface for substantially aligning with the arcuate bends.

* * * * *